US007146902B2

(12) United States Patent
Marx

(10) Patent No.: US 7,146,902 B2
(45) **Date of Patent: *Dec. 12, 2006**

(54) HYDRAULIC DIRECTIONAL CONVERTER

(76) Inventor: Michael Marx, 2660 Northfield, White Lake, MI (US) 48383

( * ) Notice: Subject to any disclaimer, the term of this patent is extended or adjusted under 35 U.S.C. 154(b) by 0 days.

This patent is subject to a terminal disclaimer.

(21) Appl. No.: 11/024,128

(22) Filed: Dec. 28, 2004

(65) Prior Publication Data

US 2005/0115303 A1 Jun. 2, 2005

Related U.S. Application Data

(63) Continuation of application No. 10/164,082, filed on Jun. 5, 2002, now Pat. No. 6,834,526.

(51) Int. Cl.
*F15B 13/04* (2006.01)

(52) U.S. Cl. ..... 91/457; 91/454

(58) Field of Classification Search ..... 91/399, 91/432, 454, 457

See application file for complete search history.

(56) References Cited

U.S. PATENT DOCUMENTS

| | | | | |
|---|---|---|---|---|
| 2,363,235 | A | 11/1944 | Ellinwood | |
| 4,225,087 | A | 9/1980 | Lawlor | |
| 5,016,464 | A | 5/1991 | Tomelleri | |
| 5,257,526 | A | 11/1993 | Teixeria | |
| 5,743,165 | A * | 4/1998 | Tanaka et al. | 91/454 |
| 5,868,059 | A * | 2/1999 | Smith | 91/454 |
| 6,109,284 | A * | 8/2000 | Johnson et al. | 137/1 |
| 6,276,257 | B1 * | 8/2001 | Hellemann | 91/442 |
| 6,352,240 | B1 * | 3/2002 | Eckstein et al. | 251/129.03 |
| 6,354,185 | B1 * | 3/2002 | Sturman | 91/454 |
| 6,537,039 | B1 * | 3/2003 | Mann | 91/432 |
| 6,834,526 | B1 * | 12/2004 | Marx | 72/453.18 |

* cited by examiner

*Primary Examiner*—Edward K. Look
*Assistant Examiner*—Michael Leslie
(74) *Attorney, Agent, or Firm*—Harness, Dickey & Pierce, P.L.C.; Kevin G. Mierzwa

(57) ABSTRACT

A hydraulic system comprises a pump having a fluid feed end a fluid release. Hydraulic actuator has an advance port and a retract port A directional converter is fluidically coupled between the pump and the hydraulic actuator. The converter has a housing having a plurality of fluid passages that terminates in a pump outlet port, a pump inlet port, a first actuator port, and a second actuator port. A plurality of valves is disposed within the fluid passages. The plurality of valves has a first position and a second position. In the first position, a fluid flow direction at the first actuator port is into said housing from the actuator and a second fluid direction and a second actuator port is out of the housing. When the switches are in a second position the fluid flow direction is out of the housing at The second actuator port.

18 Claims, 6 Drawing Sheets

HYDRAULIC DIRECTIONAL CONVERTER

RELATED APPLICATION

The present invention is a continuation of U.S. application Ser. No. 10/164,082 entitled "Hydraulic Directional Converter" filed on Jun. 5, 2002 now U.S. Pat. No. 6,834,526, and incorporated by reference herein.

TECHNICAL FIELD

The present invention relates generally to hydraulic actuators, and more specifically, to a directional converter for use with a hydraulic actuator.

BACKGROUND

Frame racks are typically used to straighten the frame of an automotive vehicle after a collision. A frame rack has a deck onto which the vehicle is placed. A number of towers are positioned around the frame rack. The towers have a chain connected thereto that is coupled to a ram. The chains are connected to the frame of the vehicle and the tower is used to pull the chain toward the tower. Typically, the chains are connected to the vehicle so that the vehicle frame is pulled out in the same direction of impact. When the pulling of the frame begins, it is often necessary to adjust the direction of pulling so the pulling force remains in the direction of impact. Oftentimes, this requires the tension to be released from the vehicle, the tower position to be adjusted, and tension placed on the vehicle frame in a slightly different direction. This, however, is a time consuming process and thus increases the expense of the collision repair.

Many frame racks employ a single directional pump. This allows the frame to be pulled in a single direction. Many times both pushing and pulling is desired.

It would therefore be desirable to provide a system for allowing flexibility in the frame straightening process.

SUMMARY OF THE INVENTION

It is therefore one object of the invention to provide a directional converter for a hydraulic actuator that can be easily maneuvered and placed on various positions of a frame rack. The directional converter allows the one-directional fluid flow from a pump to be controlled and reversed. This control allows a hydraulic actuator to be easily positioned and moved to provide pushing and pulling capabilities.

In one aspect of the invention, a directional converter for use with a pump and a hydraulic actuator comprises a housing having a plurality of fluid passages therethrough. The plurality of fluid passages terminates in a pump outlet port, a pump inlet port, a first actuator port, and a second actuator port. A plurality of valves is disposed within the plurality of fluid passages. The plurality of valves has a first position and a second position. In a first position, a fluid flow direction at the first actuator port is into the housing from the actuator, and a fluid flow direction at the second ram port is out of the housing. When the switches are in a second position the first fluid flow direction is out of the housing and the second fluid flow direction is into the housing. The valve positions are preferably set so that two of the valves are open and two of the valves are closed when in operation.

In a further aspect of the invention, a hydraulic system comprises a pump having a fluid feed and a fluid release.

Hydraulic actuator has an advance port and a retract port. A directional converter is fluidically coupled between the pump and the hydraulic actuator. The converter has a housing having a plurality of fluid passages therethrough. The plurality of fluid passages terminates in a pump outlet port, a pump inlet port, a first actuator port, and a second actuator port. The pump outlet port is coupled to the fluid release of the pump. The pump inlet port is fluidically coupled to the fluid feed of the pump. The first actuator port and second actuator port are respectively coupled to the advance port and the retract port. A plurality of valves is disposed within the fluid passages. The plurality of valves have a first position and a second position. In the first position, a fluid flow direction at the first actuator port is into the housing from the actuator and a second fluid direction and a second actuator port is out of the housing. When the switches are in a second position the fluid flow direction is out of the housing at the second actuator port.

In a further aspect of the invention, a method of operating a directional converter includes the steps of: providing a pump coupled to an actuator through a converter; actuating a plurality of switches in a first position and a second position; in a first position, flowing hydraulic fluid a first fluid flow direction at a first actuator port into a housing from the actuator and a second fluid flow direction at the second actuator port out of the housing; and when the switches are in a second position, flowing fluid in the first fluid flow direction at the first actuator port out of said housing and second fluid flow direction at said second actuator port into said housing.

One advantage of the invention is that the system may be adapted to use the single direction pump typically found on a frame rack. The system, however, is not limited to the use of the pump on frame rack and may use a stand-alone pump. Likewise, various types of hydraulic actuators may be used with the present invention. The present invention is suitable for various types of actuators in which a reverse flow is useful.

Other advantages and features of the present invention will become apparent when viewed in light of the detailed description of the preferred embodiment when taken in conjunction with the attached drawings and appended claims.

DESCRIPTION OF THE PREFERRED EMBODIMENT

Figure 1:
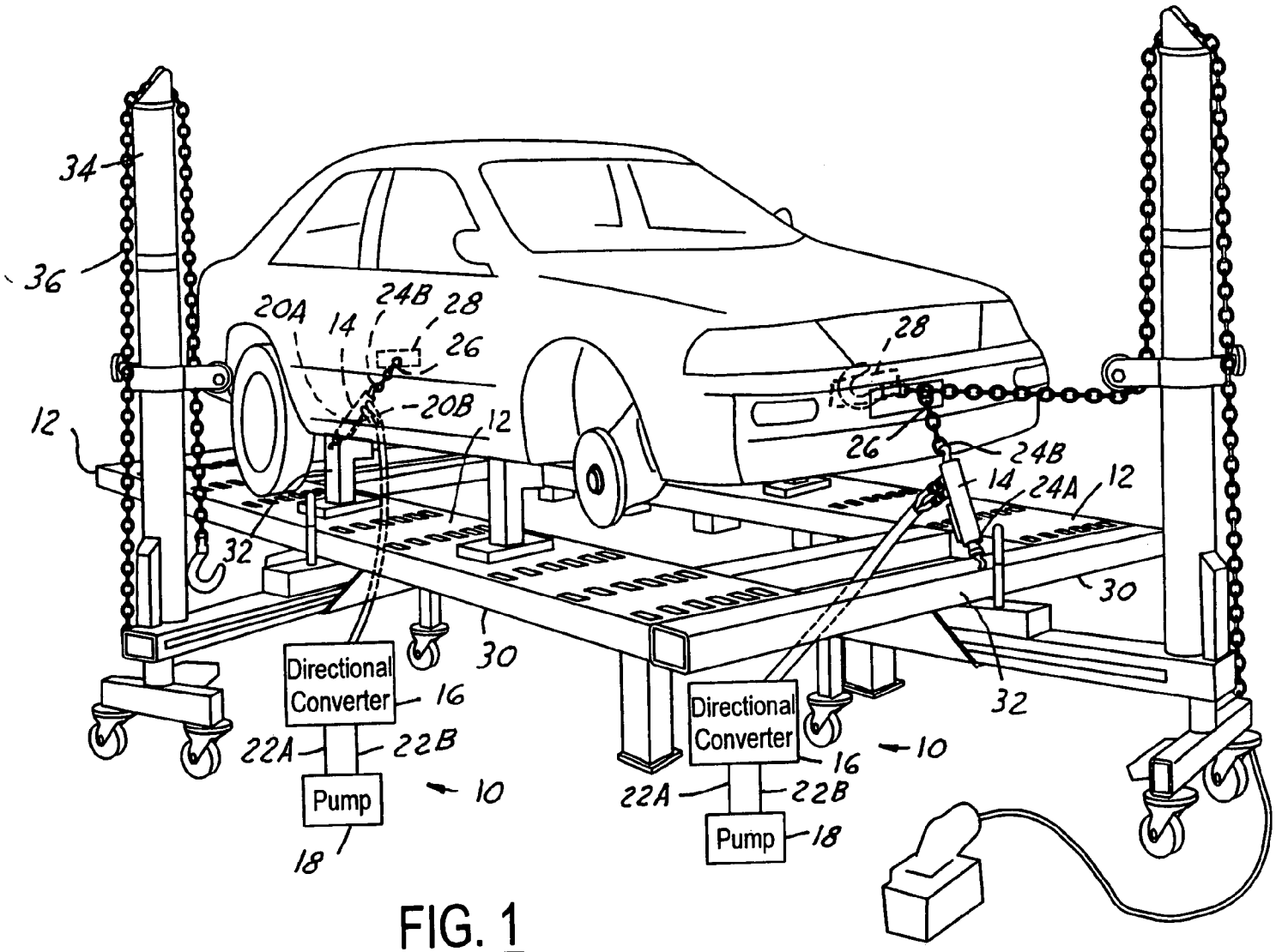
FIG. 1 is a perspective view of an automotive frame rack having a hydraulic system according to the present invention.

In the following figures, the same reference numerals will be used to identify the same components. The following description is set forth with respect to a frame rack for an automotive vehicle. However, the directional converter of the present application has several uses for hydraulic actuators. For example, the directional converter of the present invention may be used in various industries and for devices such as forklifts, manufacturing equipment and other types of equipment using hydraulic actuators such as single direction single release pumps. It should also be noted that any quantities and dimensions are provided for illustrative purposes only and should not be limiting unless set forth in the claims of the present invention.

Referring now to FIG. 1, two hydraulic systems 10 according to the present invention are illustrated. Hydraulic systems 10 are illustrated used on a frame rack 12. As mentioned above, however, the frame rack 12 is merely illustrative of one of the many uses of the present invention. Hydraulic system 10 includes a hydraulic actuator 14, a directional converter 16, and a pump 18. As illustrated, two hoses 20A and 20B, fluidically couple directional converter 16 and hydraulic actuator 14. Also, two hoses 22A and 22B fluidically couple directional converter 16 and pump 18. Hydraulic actuator 14 may have a mechanical coupling device such as a pair of claw hooks 24. It should be noted that in various applications claw hooks 24A and 24B may be substituted with other mechanical fastening devices such as bolt down components, loops or stays. Claw hook 24B is illustrated mechanically coupled to a chain 26, which in turn is coupled to a portion of a frame 28 of an automotive vehicle.

Frame rack 12 has a deck 30 for positioning a vehicle thereon. Deck 30 may have openings or tie down holes 32 positioned therein to receive claw hook 24 or other mechanical securing means for hydraulic actuator 14. Frame rack 12 may also include various towers 34 that include a ram 36 and a chain 38. Of course, different numbers of towers 34 may be used on a frame rack.

Figure 2:
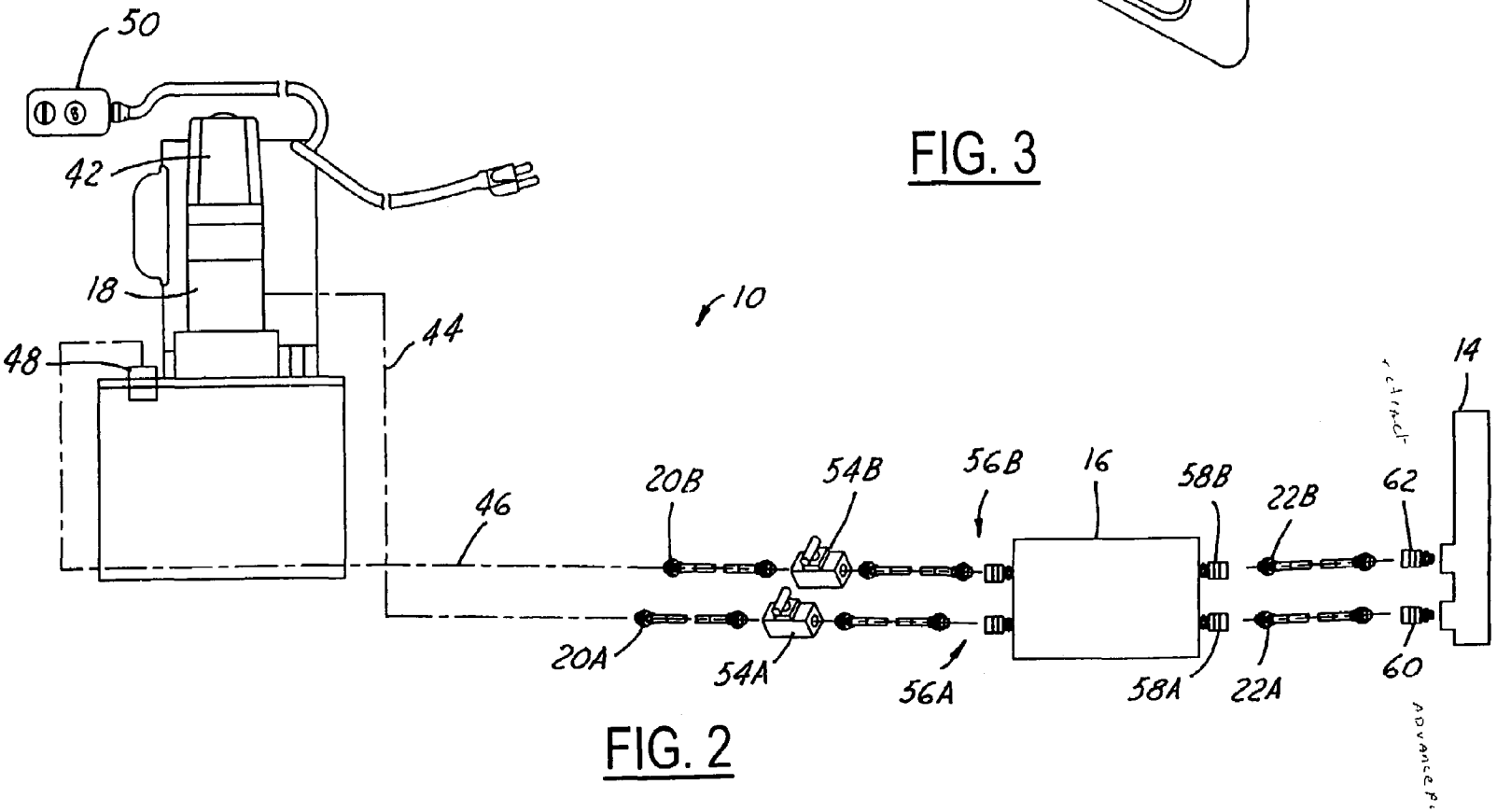
FIG. 2 is an exploded view of a hydraulic system according to the present invention.

Referring now to FIG. 2, hydraulic system 10 is illustrated in further detail. Hydraulic pump 18 may be a stand-alone pump as mentioned below in FIG. 3 or may be a pump that is integrated into the rack system. Pump 18 has a pump reservoir 40 for storing hydraulic fluid therein. Pump 18 has an electric motor 42 coupled thereto to generate pressure in hydraulic fluid passing from the pump. Pump 18 has a feed line 44 that delivers high pressure fluid to directional converter 16. Reservoir 40 has a return line or release line 46 that returns the hydraulic fluid to pump reservoir 40 through a breathable coupler 48. Pump 18 may be operated using a switch 50 that is coupled to a motor within the pump housing.

Line valves 54A and 54B may facilitate the connection or disconnection of the hoses 20A and 20B. Line valves are an optional feature.

Line valves 54A and 54B may be coupled to respective feed line 44 and release line 46. Quick couplers 56A and 56B may be coupled to respective feed line 44 and release line 46 to easily couple feed line 44 and release line 46 to directional converter 16. For example, quick couplers 46A and 46B may have a male portion or female portion coupled to feed line 44 and release line 46 while directional converter 46 may have the opposite portion of quick coupler 56A, 56B attached thereto. Quick couplers 58A and 58B may also be used to couple actuator 14 to directional converter 16. Quick couplings may also be used to attach hoses 22A, 22B to actuator 14.

Actuator 14, as mentioned above, is preferably a hydraulic ram. More specifically, actuator 14 is preferably a directional actuator having an advance port 60 and a retract port 62. By controlling the direction of fluid through directional converter 16, the actuator 14 may advance and retract (push and pull) accordingly. That is, force may be applied in both directions as opposed to a single direction device which can only pull with force but cannot push or vice versa. Directional converter 60 is used to change the direction of fluid flow to actuator 14 so that the fluid leaving directional converter causes the motion of actuator 14.

Figure 3:
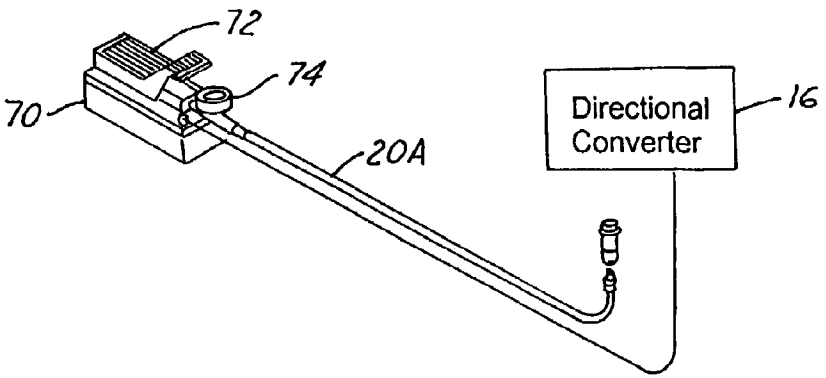
FIG. 3 is a perspective view of an alternative embodiment of a stand-alone pump hydraulic system according to the present invention.

Referring now to FIG. 3, a stand-alone pump 70 is illustrated. Stand-alone pump 70 may have a foot pedal 72 to control the operation thereof. Stand-alone pump 70 has hoses 20A and 20B coupled thereto in a similar manner to that shown above. Stand alone pump 70 is a single direction pump. The feed hose 20A may have a pressure gauge 74 thereon to monitor the pressure of the hydraulic pump.

Figure 4:
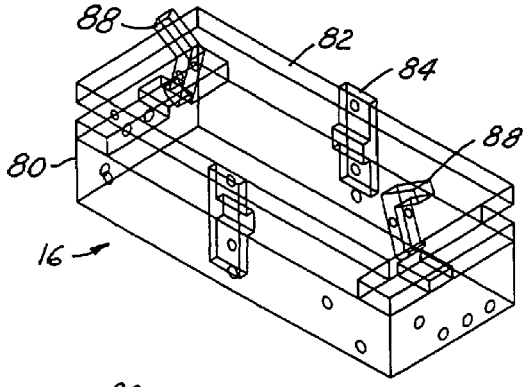
FIG. 4 is a perspective view of the directional converter according to the present invention.
Figure 5:
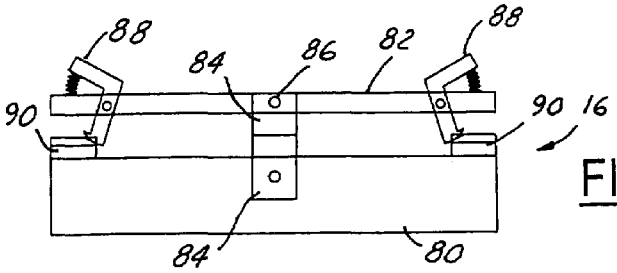
FIG. 5 is a side view of the directional converter of FIG. 4.

Referring now to FIGS. 4 and 5, a first embodiment of a directional converter 16 is illustrated in further detail. Directional converter 16 has a housing 80 and a foot pedal 82 that is pivotably attached thereto. A pair of pedal hinges 84 attached through a pedal pin 86 is used to pivot the foot pedal 82 about the pedal pin 86. A lock 88 may be located on each side of pedal 82. Lock 88 is used to engage a catch 90 positioned on housing 80. Catches 90 engage lock 88 to maintain the pedal 82 in a pivoted position. As illustrated, lock 88 extends through pedal 82. However, various types of locks may be evident to those skilled in the art.

Figure 6:
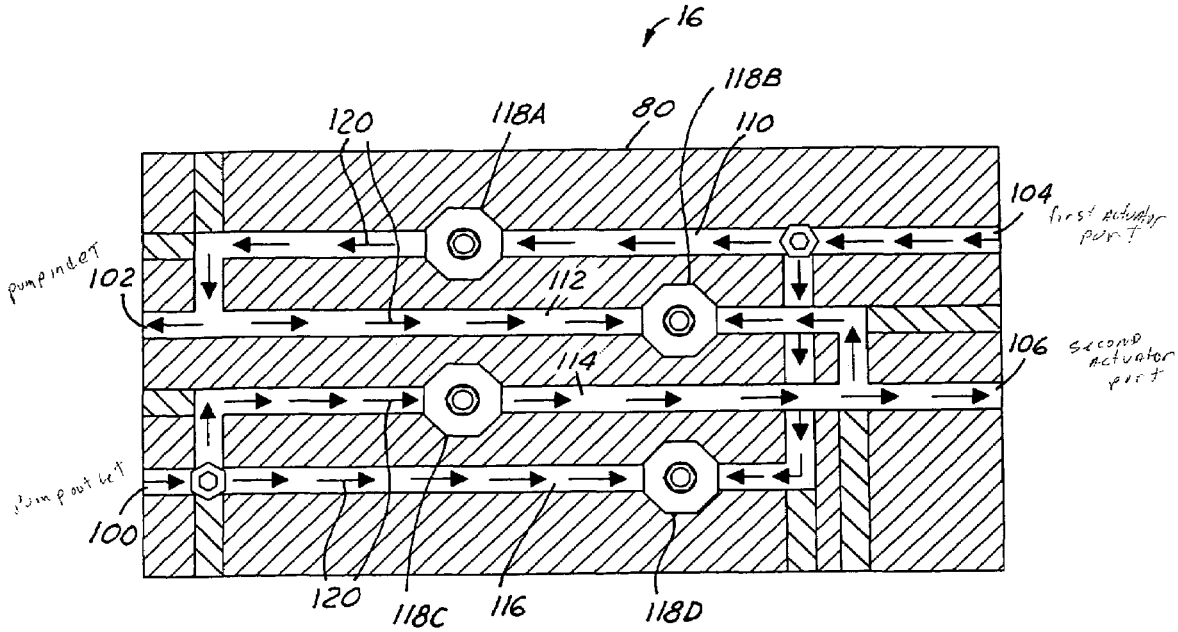
FIG. 6 is a cross-sectional view of the directional converter of FIGS. 4 and 5 showing the fluid passages in a cylinder up direction.

Referring now to FIG. 6, a cutaway view of housing 80 is illustrated in further detail. Housing 80 has a plurality of ports that are coupled to the pump and to the actuator. Preferably, four ports are provided. The ports include a pump outlet port 100, a pump inlet port 102, a first actuator port 104, and a second actuator port 106.

A plurality of fluid passages is provided between pump outlet port 100, pump inlet port 102, first actuator port 104, and second actuator port 106. As illustrated, four fluid passages are illustrated. A first fluid passage 110 is coupled between pump inlet port 102 and first actuator port 104. A second fluid passage 112 is coupled between pump inlet port 102 and second actuator port 106. A third fluid passage 114 is fluidically coupled between the pump outlet port 100 and the first actuator port 104. A fourth fluid passage 116 is fluidically coupled between the pump outlet port 100 and the first actuator port 104.

Each of the fluid passages 110, 112, 114, and 116 has a respective valve 118A–118D therein. Preferably, valves are normally closed valves. Valves 118 may be manually operated such as by foot pedal 82 above. Upon the application of pressure to the top portion of valve 118, the valve may open to allow fluid through the respective passage. In this figure, valves 118A and 118C are open and valves 118B and 118D are closed. This is referred to as a plurality of valves having a first position. The fluid flow is illustrated by arrows 120. This configuration corresponds to moving actuator up or outward. In the first fluid passage, fluid is returned from the actuator through first actuator port 104, which is coupled to the pump inlet port 102, which in turn is fluidically coupled to the reservoir of the pump. Fluid is provided to the actuator from the pump through pump outlet port 100 and is transferred through third fluid passage 114 to second actuator port 106. Because valves 118B and 118D are closed, no fluid flows through second fluid passage 112 and fourth fluid passage 116.

Figure 7:
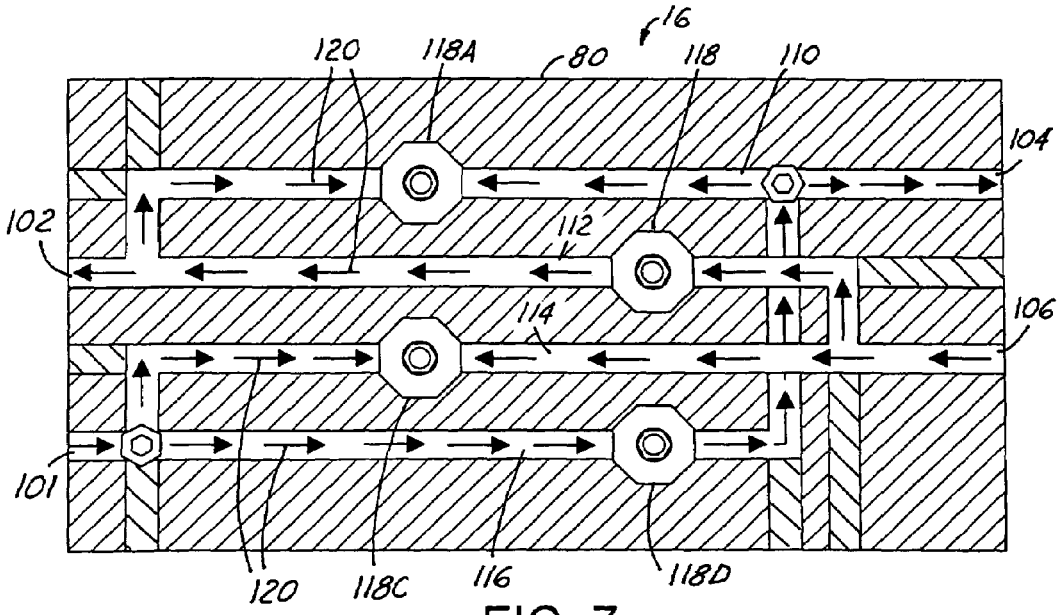
FIG. 7 is a cross-sectional view of the directional converter of FIGS. 4 and 5 showing the fluid passages in a cylinder down direction.

Referring now to FIG. 7, the position of valves 118A–118D may be referred to as the plurality of valves being in a second position. That is, valves 118A and 118C are now closed while valves 118B and 118D are open. In this manner, fluid flows from second actuator port 106 through valve 118B to pump inlet port 102. Fluid flows from pump outlet port 100 through valve 118D to first actuator port 104. This configuration corresponds to retracting the actuator.

Figure 8:
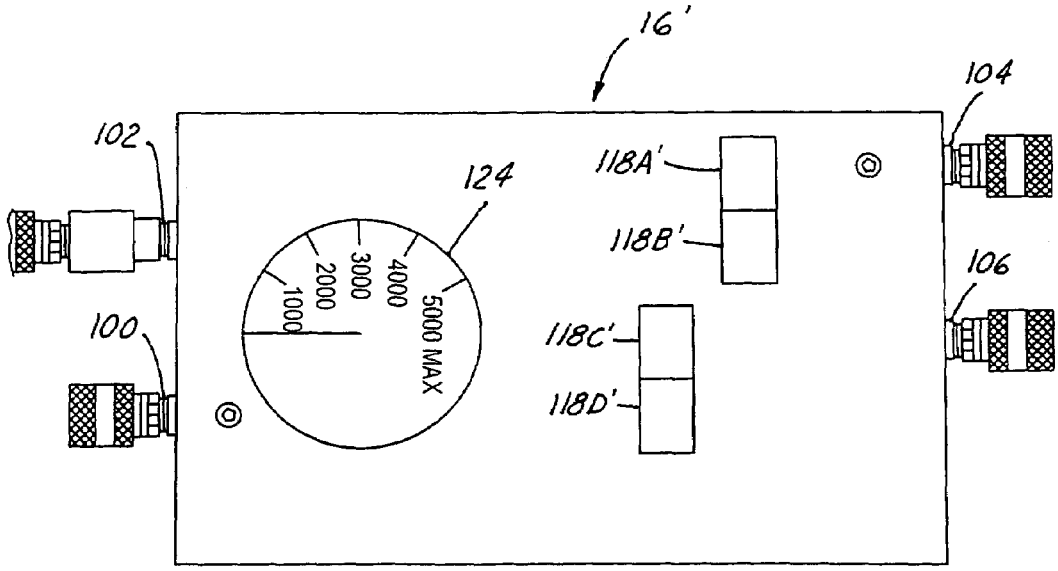
FIG. 8 is an alternative configuration of a directional converter according to a second embodiment of the invention.
Figure 9:
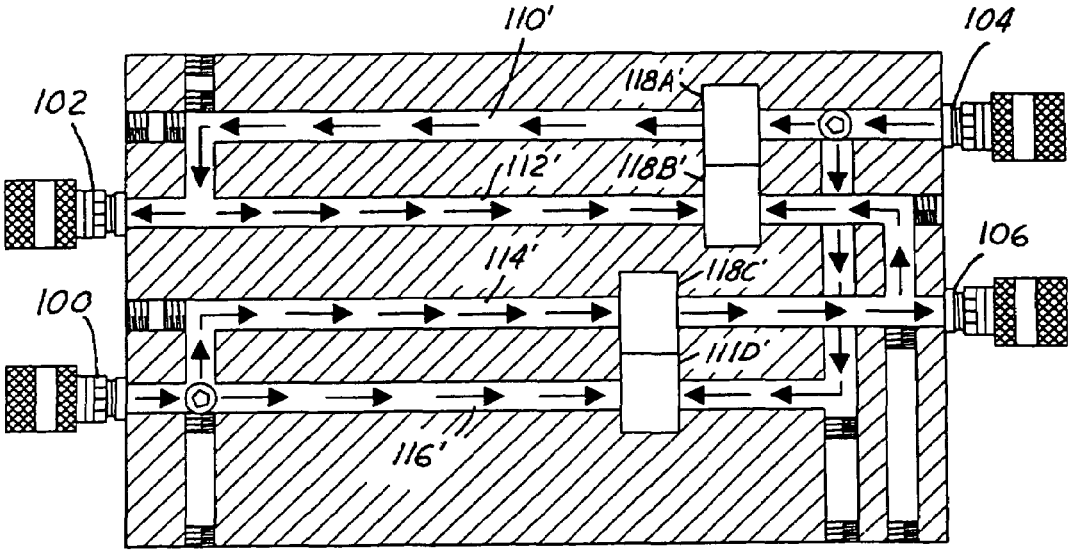
FIG. 9 is a cross-sectional view illustrating the fluid passages of the embodiment of FIG. 8 in a cylinder up configuration.

Referring now to FIG. 8, a second embodiment of directional converter 16' is illustrated. Directional converter 16' in this embodiment has a pressure gauge 124 that is fluidically coupled to pump outlet port 100 to measure the hydraulic fluid from the pump. In this embodiment valves 118A', 118B', 118C', and 118D' have been located in slightly different positions than those of valves 118A–118D shown in FIGS. 6 and 7 but still in the same passages. Valves 118A'–118D' in this embodiment may be hand operated rather than operated by a foot pedal 82 shown above. The operation of FIG. 9 is similar to that of FIG. 6 in that the fluid flows through the directional converter 16' in a similar manner.

Figure 10:
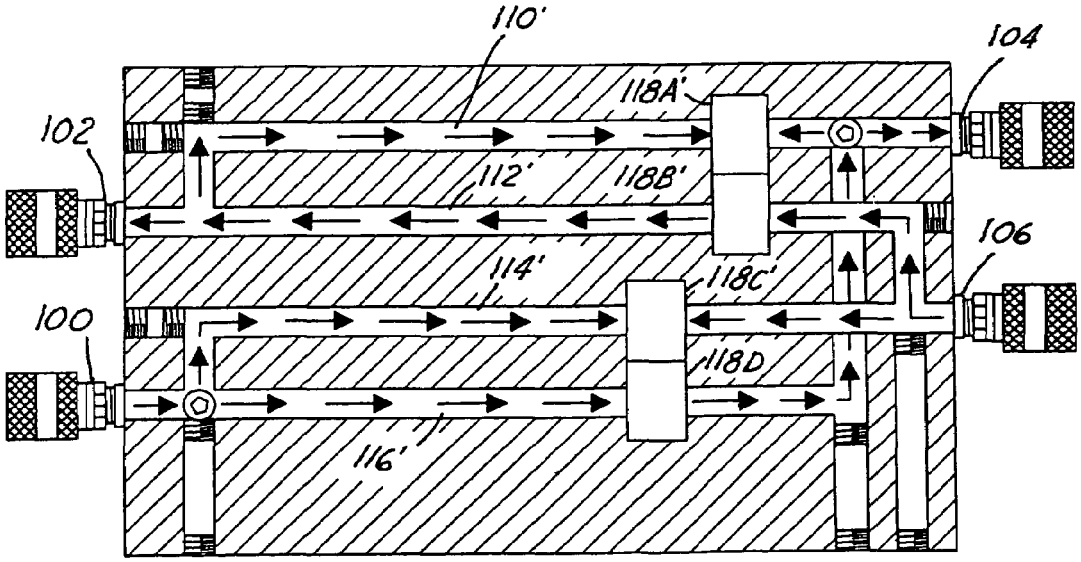
FIG. 10 is a cross-sectional view illustrating the fluid passages of the embodiment of FIG. 8 in a cylinder down configuration.
Figure 11:
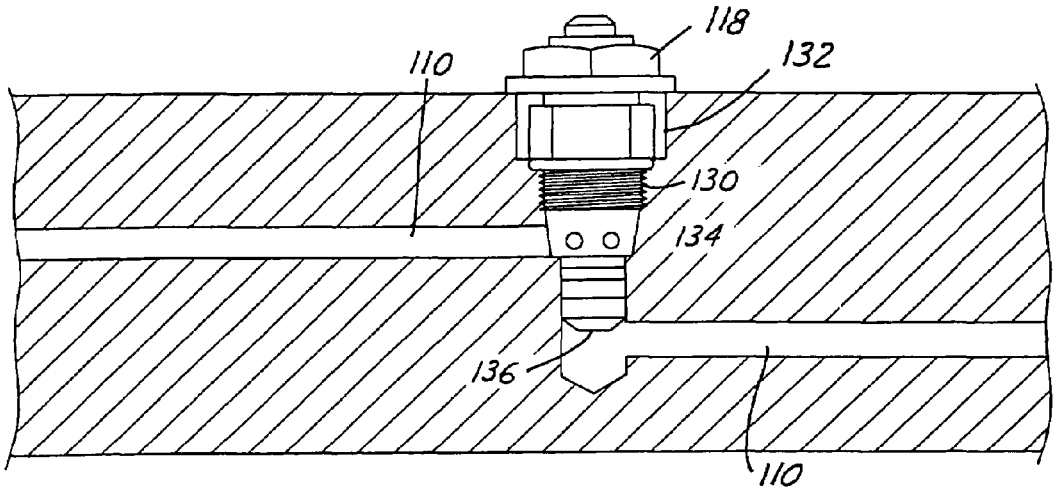
FIG. 11 is a side cross-sectional view of a typical valve within a fluid passage according to the present invention.

Referring now to FIG. 10, a typical valve 118 is illustrated in further detail. To facilitate assembly, valve 118 has threads 130 thereon which may be used to secure valves 118 within an opening 132. As is illustrated, the fluid passages may be in more than one plane. Fluid passes through the valve 118 when it is opened through valve ports 134 which in turn allow the fluid to flow through a bottom portion 136 of valve 118.

Figure 12:
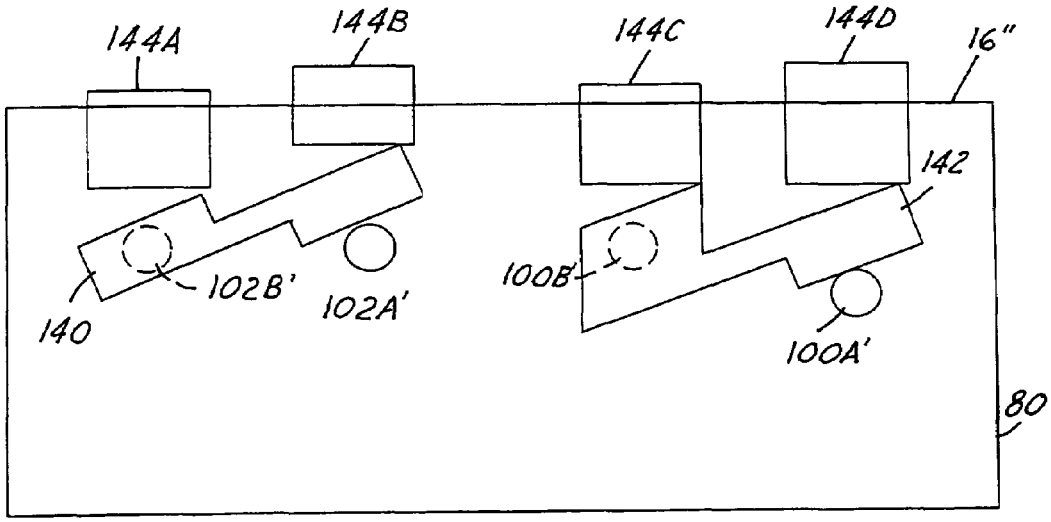
FIG. 12 is a side view of an alternative switch/valve configuration for the valve of the present invention.

Referring now to FIG. 12, a third alternative embodiment of directional converter 16" is illustrated. In this embodiment, a pair of rocker switches 140 and 142 is actuated by push buttons 144A, 144B, 144C, and 144D. In this embodiment the side view of housing is illustrated. In this embodiment, two ports per pump outlet port may be utilized. These ports are labeled as 100A' and 100B'. Likewise, two pump inlet ports 102A' and 102B' are illustrated. By moving the position of rocker switches 140 and 142, different fluid passages may be coupled to the pump, which can result in the change of movement of the housing through block 80. Rocker switches may also be provided on the opposite side of block corresponding to the first actuator port and the second actuator ports.

As can be seen, a one directional pump may be used in two directions and thus allow the flexibility in such applications as frame rack applications.

While particular embodiments of the invention have been shown and described, numerous variations and alternate embodiments will occur to those skilled in the art. Accordingly, it is intended that the invention be limited only in terms of the appended claims.

What is claimed is:

1. A directional converter for use with a pump and a hydraulic ram having an advance port and a retract part comprising:

a housing having a plurality of fluid passages therethrough, said plurality of passages terminating in a pump outlet port, a pump inlet port, a first ram port and a second ram part;

a first hose coupling the pump inlet part and the pump:

a second hose coupling the pump outlet port and the pump;

a third hose coupling the first ram part the advance port;

a fourth hose coupling the second ram port and the retract port; and a switch pivotally coupled to a face of the housing, having a first switch position and a second switch position;

a plurality of valves disposed within said plurality of fluid passages extending to the face of the housing and coupled to the switch, said plurality of valves having a first position corresponding to the first switch position and a second position corresponding to the second switch position, wherein in the first position and first switch position a first fluid flow direction at the first ram port is into said housing from the ram and a second fluid flow direction at the second ram port is out of the housing and when the valves are in a second position and the switch in the second switch position the first fluid flow direction at the first ram port is out of said housing and second fluid flow direction at said second ram port is into said housing.

2. A directional converter as recited in claim 1 further comprising a first quick coupling between the first ram port and the third hose.

3. A directional converter as recited in claim 1 further comprising a second quick coupling between the second ram port and the fourth hose.

4. A directional converter as recited in claim 1 wherein the plurality of valves comprise threaded valves securing the plurality of valves within the housing.

5. A hydraulic system as recited in claim 1 further comprising a pedal coupled to said housing, said pedal operably coupled to said plurality of valves.

6. A directional converter as recited in claim 5 further comprising a lock operably coupled between said pedal and said housing.

7. A hydraulic system as recited in claim 1 wherein the hose couplings are disposed on at least two different faces of the housing.

8. A hydraulic system comprising;

a single direction pump having a fluid feed and a fluid release;

a hydraulic ram having an advance port and a retract port;

a directional converter fluidically coupled to said pump and said hydraulic ram, said directional converter comprising, a housing having a plurality of fluid passages therethrough, said plurality of passages terminating in a pump outlet port, a pump inlet port, a first ram port and a second ram port; and a switch pivotally coupled to a face of the housing, having a first switch position and a second switch position;

a plurality of valves disposed within said plurality of fluid passages extending to the face of the housing and coupled to the switch, said plurality of valves having a first position corresponding to the first switch position and a second position corresponding to the second switch position, wherein in the first position and first switch position a first fluid flow direction at the first actuator port is into said housing from the ram and a second fluid flow direction at the second ram port is out of the housing and when the plurality of valves are in a second position and the switch in the second switch position, the first fluid flow direction at the first ram port is out of said housing and second fluid flow direction at said second ram port is into said housing.

9. A hydraulic system as recited in claim 8 further comprising a pedal coupled to said housing, said pedal operably coupled to said plurality of valves.

10. A hydraulic system as recited in claim 9 further comprising a lock operably coupled between said pedal and said housing.

11. A hydraulic system as recited in claim 8 wherein the pump comprises a stand-alone pump.

12. A hydraulic system as recited in claim 8 wherein the plurality of valves comprise threaded valves securing the plurality of valves within the housing.

13. A hydraulic system as recited in claim 8 further comprising a first hose coupling the pump inlet port and the pump; a second hose coupling the pump outlet port and the pump: a third hose coupling the first ram port and the advance port; a fourth hose coupling the second ram port and the retract port.

14. A hydraulic system as recited in claim 8 further comprising a first quick coupling between the first ram port and the third hose.

15. A hydraulic system as recited in claim 8 further comprising a second quick coupling between the second ram port and the fourth hose.

16. A hydraulic system as recited in claim 8 wherein the hose couplings are disposed on at least two different faces of the housing.

17. A method for operating a hydraulic ram comprising:

providing a single direction pump coupled to an actuator through a converter;

actuating a switch disposed on a face of a housing from a first position and to a second position;

actuating valves disposed within a plurality of fluid passages and extending to the face with the switch;

when the switch is in a first position, flowing hydraulic fluid a first fluid flow direction at a first ram port into a housing from the ram and a second fluid flow direction at the second ram part out of the housing; and when the switch is in a second position, flowing fluid in the first fluid flow direction at the first ram port out of said housing and second fluid flow direction at said second ram port into said housing.

18. A method as recited in claim 17 wherein actuating the switch comprises actuating a foot pedal.

* * * * *